United States Patent [19]

Oehy

[11] 4,434,532

[45] Mar. 6, 1984

[54] APPARATUS AND METHOD FOR DEPOSITING TEXTILE FIBER SLIVER

[75] Inventor: Peter Oehy, Winterthur, Switzerland

[73] Assignee: Rieter Machine Works, Ltd., Winterthur, Switzerland

[21] Appl. No.: 374,880

[22] Filed: May 4, 1982

[30] Foreign Application Priority Data

May 4, 1981 [CH] Switzerland ..... 2873/81

[51] Int. Cl.[3] ..... B65H 54/80

[52] U.S. Cl. ..... 19/159 R

[58] Field of Search ..... 19/159 R, 159 A

[56] References Cited

U.S. PATENT DOCUMENTS 2,695,429 11/1954 Howes et al. ..... 19/159 R
3,503,197 3/1970 Fess et al. ..... 19/159 R
4,228,563 10/1980 Weber ..... 19/159 R

FOREIGN PATENT DOCUMENTS 64584 11/1982 European Pat. Off. ..... 19/159 R

*Primary Examiner*—Louis Rimrodt
*Attorney, Agent, or Firm*—Kenyon & Kenyon

[57] ABSTRACT

The textile fiber sliver is deposited in cans in the form of cycloid-type loops. During deposition, the sliver is delivered via a rotating funnel gear wheel into a rotating can. In addition, the mutual distance between the axes of rotation of the gear wheel and can is varied by laterally displacing the can. Also, the rotational speed of the can is varied during operation so that when the distance between the axes of rotation of the wheel and can is at a minimum, the can rotates at a maximum speed. Likewise, when the distance between the axes of rotation is at a maximum, the can rotates at a minimum rotational speed.

15 Claims, 6 Drawing Figures

APPARATUS AND METHOD FOR DEPOSITING TEXTILE FIBER SLIVER

This invention relates to an apparatus and method for depositing a textile fiber sliver in a can.

As is known, various techniques have been used for depositing textile fiber slivers in containers. For example, it has been known to deposit a sliver in the form of cycloid-type loops in a can which rotates about its longitudinal axis. Further, as described in German DOS No. 28 02 216, the deposition and re-filling of a sliver into a can can be effected using a funnel gear wheel. In order to avoid or to reduce jamming or a drafting of the sliver which is being deposited in the can, the funnel gear wheel, at least in the case of large windings, and the can, in the case of small winding, are rotated at a periodically varying angular velocity using a speed variation gear arrangement. Generally, these changes in angular velocity are effected in the rythm of the funnel gear wheel revolutions, that is, at a very high frequency. As a result, considerable forces are generated. Usually, the formation and the configuration of the fiber loops which are deposited in the can are not affected by these measures. However, it has been found that the degree of can filling is insufficient using such techniques.

In order to increase the sliver capacity of a can, it has been known, for example, as described in Japanese Patent No. 48-3091, to subject the can to a translatory movement in addition to a rotational movement during deposition of the fiber sliver into the can. In this arrangement, the funnel gear wheel is fixedly arranged with respect to the can. However, it has been found that the sliver distance between the individual loops of the sliver deposited in the can varies according to the diameter of the can. Because of this, the fiber sliver becomes drafted and uneven portions, particularly in thickness, are generated. These irregularities can ultimately effect the final product.

Accordingly, it is an object of the invention to be able to fill a sliver can to a maximum capacity.

It is another object of the invention to deposit sliver in a can without introducing irregularities in the sliver.

It is another object of the invention to maintain the evenness of a fiber sliver deposited in a can.

Briefly, the invention provides an apparatus and method for depositing a textile fiber sliver in a can.

The apparatus is comprised of a rotatable turntable for supporting a can thereon to rotate about a first longitudinal exis and a funnel gear wheel which is rotatably mounted above the turntable on a second longitudinal axis which is spaced from and parallel to the axis of the turntable. The gear wheel is also provided with a funnel for passage of a sliver, which funnel is radially offset from the axis of the gear wheel. In addition, the apparatus includes means for moving the turntable relative to the gear wheel in order to vary the lateral distance between the axes of the gear wheel and turntable. Further, in accordance with the invention, a means is provided for varying the rotational speed of the turntable as a function of the lateral distance between the axes of the gear wheel and turntable such that the turntable is rotated at a maximum speed with the lateral distance between the axes of rotation being at a minimum. Likewis, the turntable is rotated at a minimum speed with the lateral distance between the axes of rotation being at a maximum.

The apparatus also includes a drive means, such as a drive shaft, which is rotatable at a constant speed and is connected with the means for varying the rotational speed of the turntable. In addition, a rotation-imparting element is connected to and between the means for varying the rotational speed of the turntable and the turntable.

The method resides in the steps of rotating a can about a first longitudinal axis, rotating a gear wheel above the can on a second longitudinal axis parallel to and spaced from the first axis, guiding a sliver through a funnel of the gear wheel which is radially offset from the axis of the gear wheel into the can and moving the truntable relative to the gear wheel to vary the lateral distance between the axes of rotation. In addition, the rotational speed of the turntable is varied as a function of the lateral distance between the axes of rotation.

The invention thus permits an improved degree of can filling as well as an improvement in the overall look or appearance of the filled can. In addition, a good evennes of the lateral distances between the adjacent sliver loops is obtained.

These and other objects and advantages of the invention will become more apparent from the following detailed description taken in conjunction with the accompanying drawings wherein.

Figure 2:
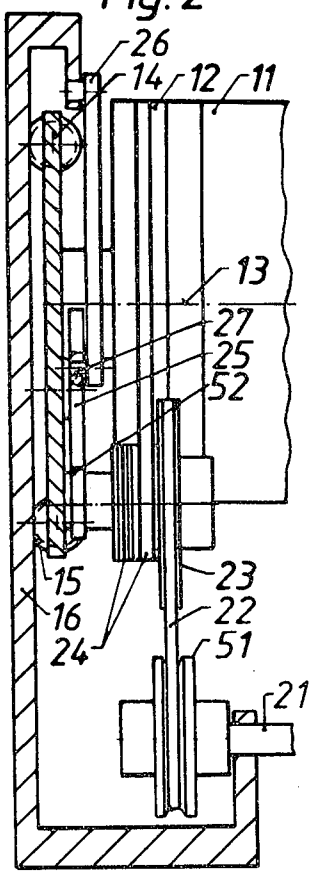
FIG. 2 illustrates a view taken on line II—II of FIG. 1.
Figure 1:
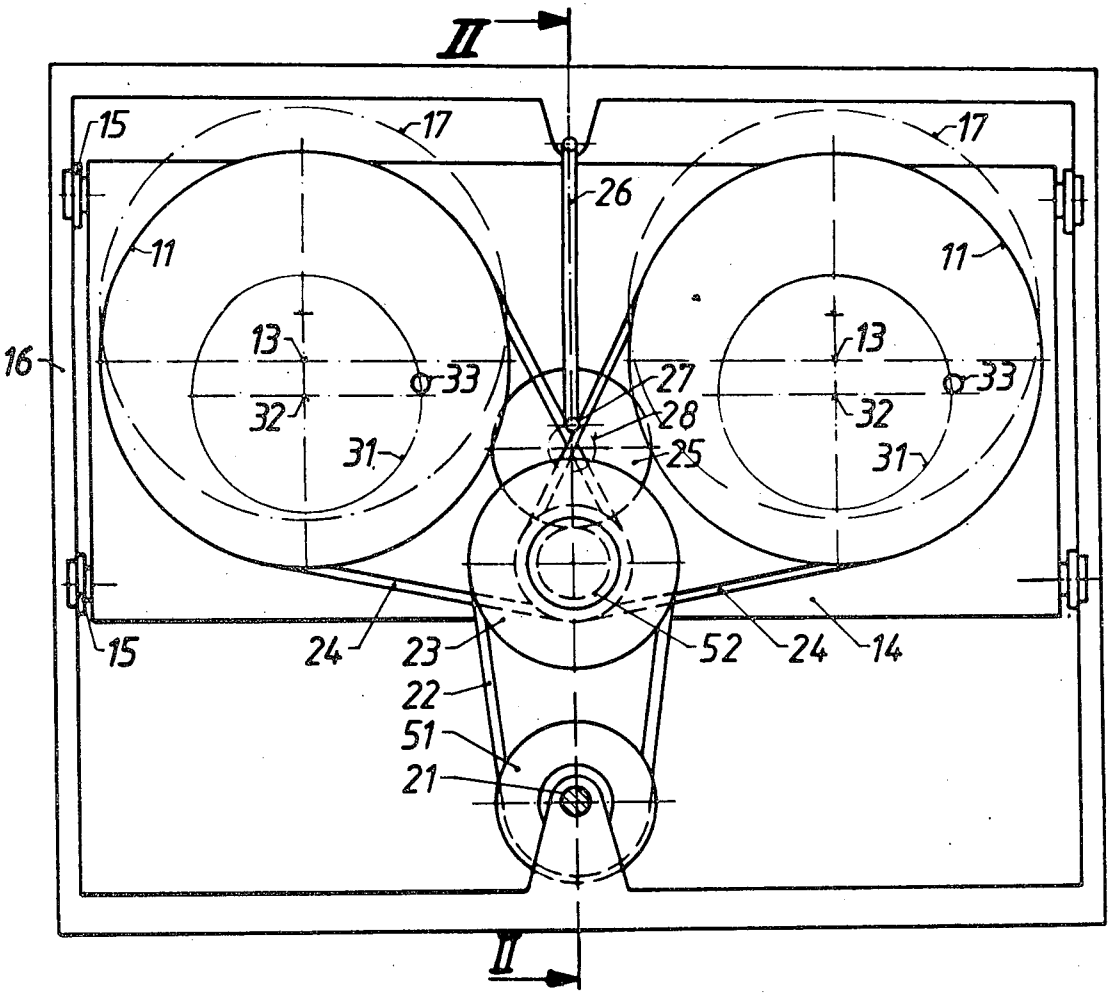
FIG. 1 illustrates a top view of an apparatus according to the invention.

Referring to FIGS. 1 and 2, the apparatus for depositing textile sliver into a can has a fixed frame F which is sized to accommodate two cans 11 for taking up respective fiber slivers (not showns).

As shown, the apparatus has a pair of rotatable turntables 12, each of which is rotatably mounted in bearings (not shown) and supports a can 11 to rotate about a longitudinal axis 13. A funnel gear wheel 31 is also rotatably mounted above each turntable 12 on a longitudinal axis 32 which is spaced from and parallel to the axis 13 of the turntable 12. Each gear wheel 31 also has a funnel 33 for the passage of a sliver to be deposited therethrough. As inicated in FIG. 1, each funnel 33 is radially offset from the axis 32 of the gear wheel 31. The distance from the axis 32 determines the deposition radius of the funnel gear wheel 31.

A means is also provided for moving the turntables 12 relative to the gear wheels 31 in order to vary the lateral distance between the respective axes of rotation 13, 32. This means includes a plate 14 in which the bearings (not shown) of the turntables 12 are supported. The plate 14 is, in turn, supported on pairs of rolls 15 which ride on rails 16 which serve to guide the plate 14 in a rectilinear path within the frame F. In addition, a disc 25 is rotatably mounted on the plate 14 and a crank rod 26 is pivotally mounted at one end on the frame F while being connected eccentrically to the disc 25 at the opposite end via a rotational bearing 27. As the disc 25 rotates, the bearing 27 for the crank rod 26 follows a circular path 28.

The apparatus is also provided with a means for varying the rotational speed of the turntables 12 as a function of the lateral distance between the axes of rotation 13, 32 of the respective turntables 12 and gear wheels 31. A drive means, for example in the form of a drive shaft 21 which is rotatable at a constant speed, is connected to the turntables 12 via a rotation-imparting element 23 as described below. As indicated in FIGS. 1 and 2, the drive shaft 21 is rotatably mounted in the fixed frame F to rotate at a constant speed. The rotation-imparting element 23 is in the form of a V-belt pulley which is coupled to the disc 25 via a gear 52 for rotation of the disc 25. To this end, the disc 25 is provided with teeth on the periphery. Suitable belts 24 also couple the pulley 23 with the respective turntables 12.

The means for varying the rotational speed of the turntables 12 includes a V-belt pulley 51 which is coupled to the drive shaft 21 and a V-belt 22 which is connected between the pulleys 51, 23.

Figure 5:
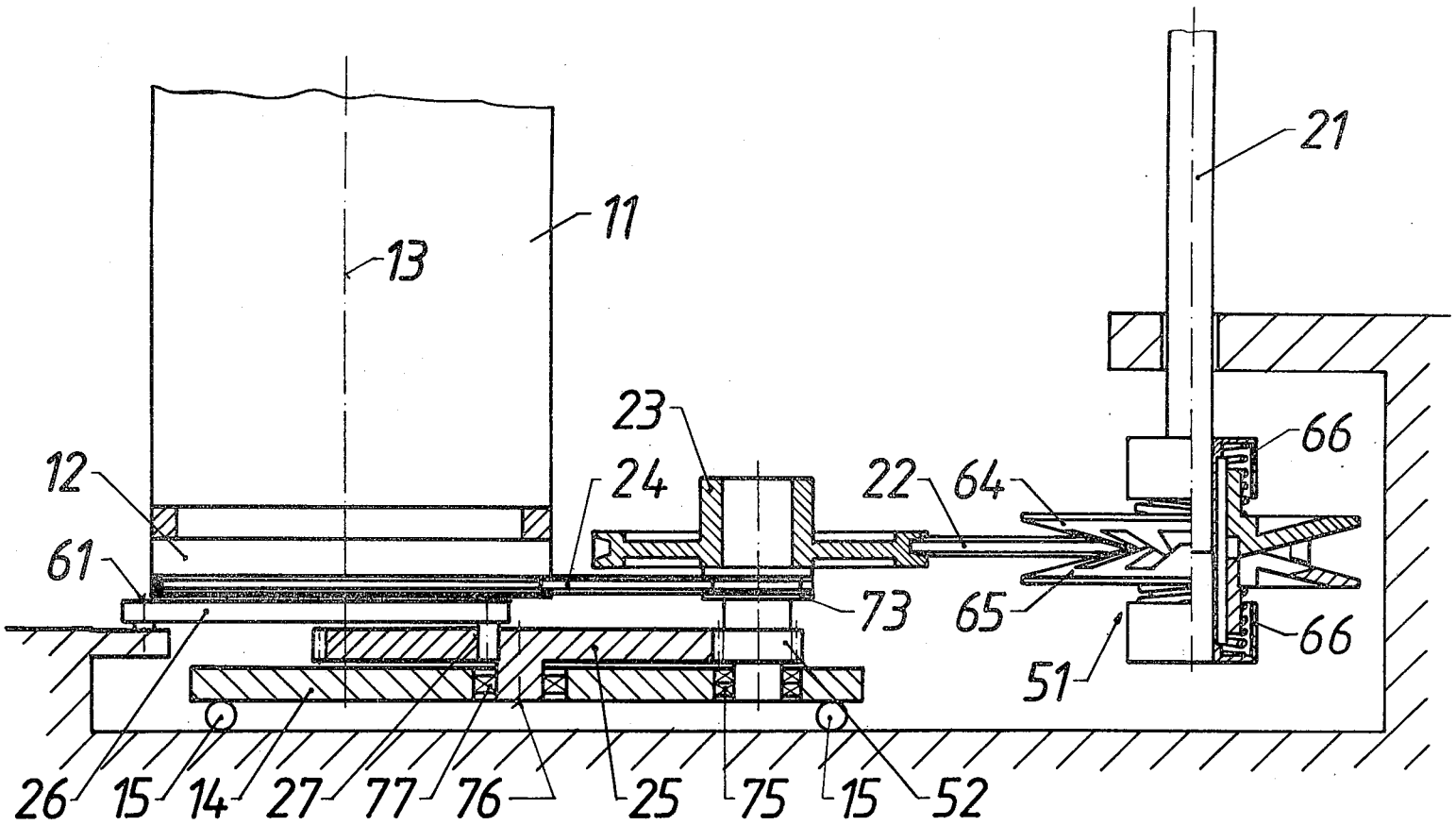
FIG. 5 illustrates an enlarged side view of the apparatus of FIG. 1.

Refferring to FIG. 5 wherein like reference characters indicate like parts as above, the pulley 51 includes a pair of pulley halves 64, 65 which are biased toward each other via springs 66. The pulley halves 64, 65 are shiftable in the longitudinal direction of the drive shaft 21 by which they are driven.

As indicated in FIG. 5, the pulley 23 is coaxially mounted with plleys 73 (only one of which is shown) about which the belts 24 for driving the turntables 12 are mounted. The gear 52 for driving the disc 25 is also mounted on the same axis and is supported in common therewith via rotational bearings 75 in the plate 14. As is also indicated, the disc 25 is mounted to rotate about an axis 76 and is supported in a rotational bearing 77 in the plate 14.

Referring to FIG. 1, during operation, each of the funnel gear wheels 31 is constantly rotated about the respective axis 32. In addition, the drive shaft 21 is rotated at a constant speed and sets the pulleys 51, 23 into rotation. The pulley 23, in turn, drives the belt 24 to effect rotation of the turntables 12 and the cans 11 placed thereupon. In addition, the disc 25 is rotated such that the plate 14 is moved to and fro on the rolls 15 along the rails 16.

Figure 3:
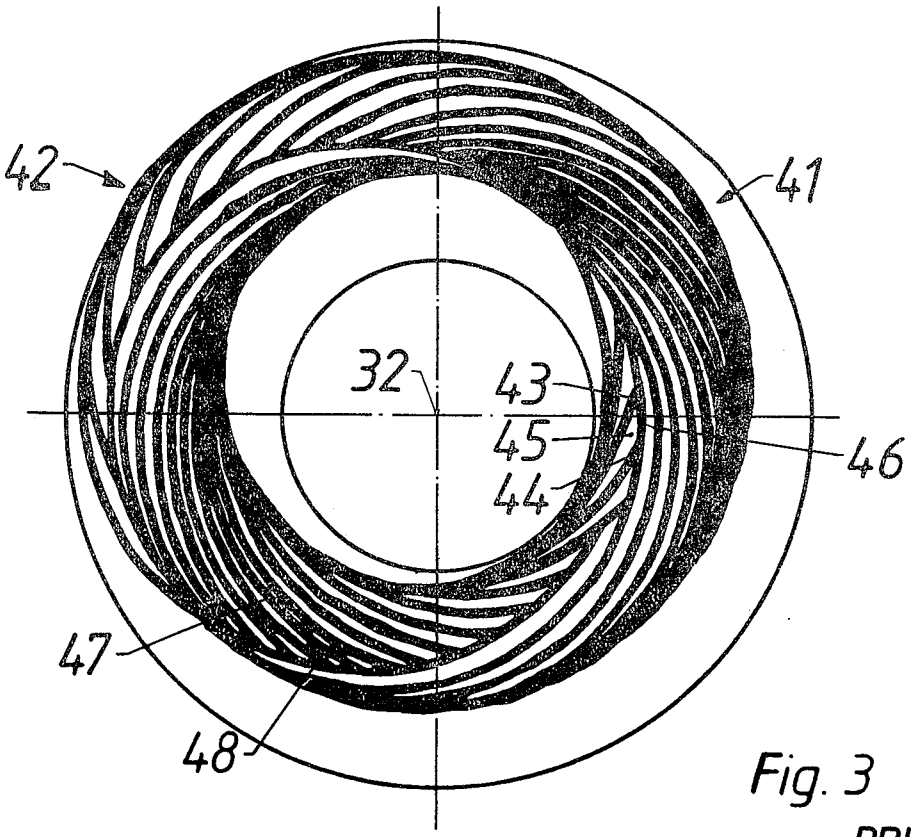
Fig. 3 PRIOR ART
FIG. 3 illustrates a top view of a can filled with fiber sliver in accordance with the prior art.
Figure 4:
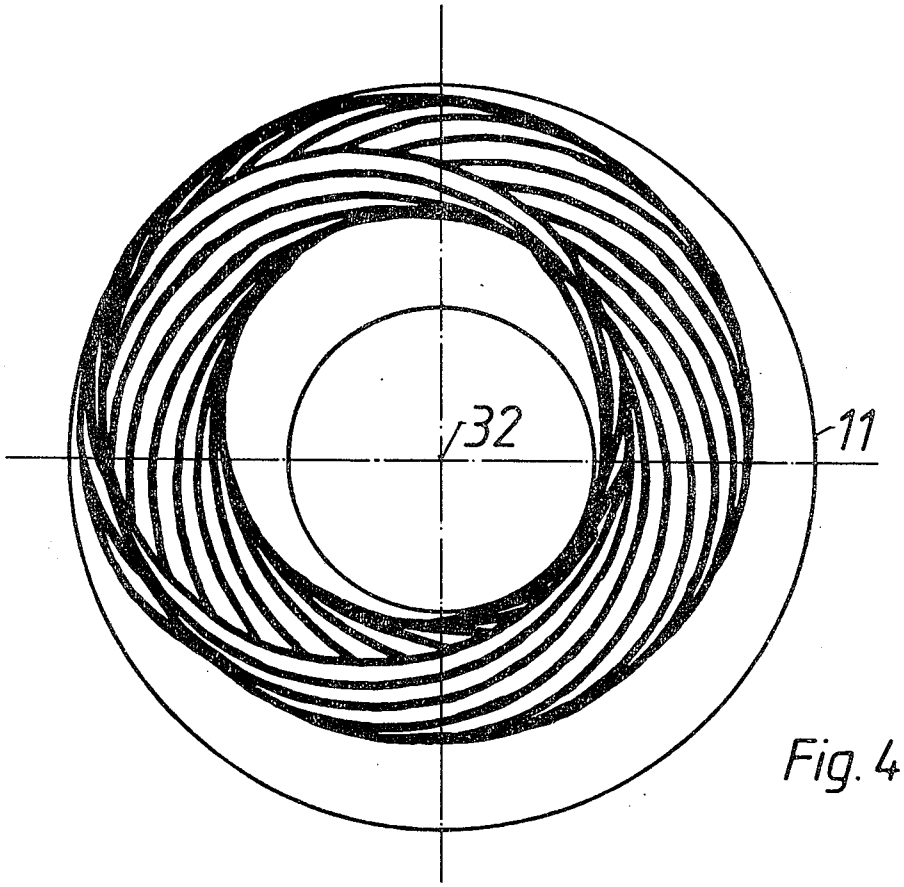
FIG. 4 illustrates a top view of a can filled with sliver in accordance with the invention.

Due to the simultaneous rotation of the gear wheel 31 and the cans 11, for example for each revolution of a can 11, the gear wheel 31 effects 20 revolutions, a fiber sliver is deposited in each can 11 with cycloid-type neighboring loops. However, the zone about the respective axis 13 of rotation in each can 11 remains free in such a manner that a hole is formed in the filled can. This process of deposition can be affected, as is generally known in spinning mills "about the hole" or "up to the hole", i.e., outside the hole zone. In depositing "about the hole", the funnel 33 of the gear wheel 31 rotates about the axis 3 of the can. In depositing "up to the hole", the funnel 33 rotates on a path confined between the axis 13 and the cylindrical wall of the can 11. FIGS. 3 and 4 illustrate the deposition "about the hole".

Because of the rotation of the cans 11 and the translatory motion of the plate 14 an improved filling of the cans 11 is achieved. As indicated in FIG. 1, the end positions of the cans 11 are indicated in solid line and in dash-dotted line 17.

As shown in FIG. 3, if the sliver is deposited with only the combination of the rotation and the translation of the cans 11, a good degree of canned filling is achieved. However, the loops are placed relatively close together in one zone 41 while being at relatively large mutual distances in another zone 42. Accordingly, in order to avoid this unevenness in the distribution of the sliver, the rotational speed of the cans 11 is varied such that each can 11 rotates at a maximum rotational speed while the lateral displacement of the can 11, i.e. the distance of the axis 13 from the axis 32, is at a minimum. At this time, the sliver is deposited in the innermost zone of the can 11. Correspondingly, the rotational speed of the can 11 is slowest while the rotational axes 13, 32 are located at their maximum mutual distance, i.e., while the silver is being deposited near the wall of the can 11.

To this end, when the plate 14 is moved toward the right, as viewed in FIG. 5, the pulley 23 also moves toward the right. Thus, the belt 22 slackens. However, this is immediately offset under the influence of the pretension exerted by the springs 66. This causes the pulley halves 64, 65 to be pressed closer together until the tension on the belt 22 is again balanced against the pretension exerted by the springs 66. The pressing together of the pulley halves 64, 65 also causes a radial outward movement of the belt 22 on the pulley 51. Thus, the radius of the pulley 51 which is effective for the belt 22 increases and the speed ratio of the pulleys 51, 23 is correspondingly adapted.

As indicted, each pulley half 64, 65 has a conical surface which engages the belt 22 in facing relation to the opposite pulley half. Where the generating lines of these rotationally symmetric surfaces are straight lines, the speed ratio of the pulleys 51, 23 changes in proportion to the mutual distance of these pulleys and to the radial distance of the belt 22, respectively. However, the pulley halves may be provided with curved surfaces so that any variation of the speed ratio can be chosen as a function of the mutual distance between the pulley halves.

Of note, the pulley 23 can be made of two pulley halves which are biased towards each other rather than the pulley 51.

Referring to FIG. 1, as the cans move from the dotted line position 17 into the full line positions, the distance between the axes 13, 32 decreases and the rotational speed of the cans increase.

Due to the variation in the rotational speed of the cans, the deposition pattern of the fiber sliver shown in FIG. 4 is obtained. As shown, the distances between the neighboring sliver loops are much more even. Thus, the zones 41, 42 as shown in FIG. 3, in which sliver loops are placed too close together or too far apart are eliminated. If the setting for the lateral displacements and for the variations of the rotational movements of the cans 11 are correspondingly chosen, the successively deposited cycloid-shaped loops of the fiber sliver are placed adjacent to each other with great precision. In this manner, the danger of a deformation of the fiber sliver due to loops being placed too close together is avoided. In this respect, under the assumption that a free intermediate space 45 (see FIG. 3) would be present between fiber silver segments 43, 44, a danger exists that a sliver segment 46 which is later deposited at a bias might sag down into this intermediate space 45. The subsequent windings would thereafter press the sliver segment 46 into the intermediate space 45. Thus, the danger exists that such sagging sliver segments would be drafted in some manner. Further, htis drafting cannot be completely eliminated in the subsequent processing of the sliver. However, as indicated in FIG. 4, such intermediate spaces are eliminated with the variation in the speed of the cans 11.

It is of advantage if the rotational speed of a can 11 is chosen such that the momentary speed does not deviate more than fifty percent from the average rotational speed of the can. For example, the maximum speed of the turntable 12 and can 11 would be fifty percent more than the average speed of the turntable 12 when the distance between the axes 13, 32 is a minimum and the minimum speed would be fifty percent below the average rotational speed of the turntable 12 when the distance between the axes 13, 32 is at a miximum.

With respect to FIGS. 3 and 4, the loops of the fiber sliver are indicated by single lines. In reality, the slivers are larger and are placed closer together than as shown. For this illustration, a can of 600 millimeters (mm) diameter and a funnel gear wheel with a deposition radius of 218 millimeters (mm) were used.

It should also be mentioned that the lateral displacement of the plate 14 along the rail 16 is influenced by the adapted rotational speed of the pulley 23. If the disc 25 would be driven directly by the drive shaft 21 at a constant rotational speed, the translatory movement of the plate 14 would be effected according to a sine function. However, due to the coupling of the disc 25 with the pulley 23, together with the slower rotation speed of the can 11 in the zone of the circle 17, the translation movement of the plate 14 is slower in the zone of the can position shown in FIG. 1. These different speeds of the lateral displacement effect an additional improvement relative to the adjacent deposition of the fiber sliver loops and the degree of can filling.

Of note, it is of no consequence whether the lateral displacement of the can 11 is effected parallel to the plane determined by the axes 12, 32 or is effected at an angle with respect to this plane. Furthermore, the lateral displacement need not be effected along a straight line but may also be of the rotary type.

Figure 6:
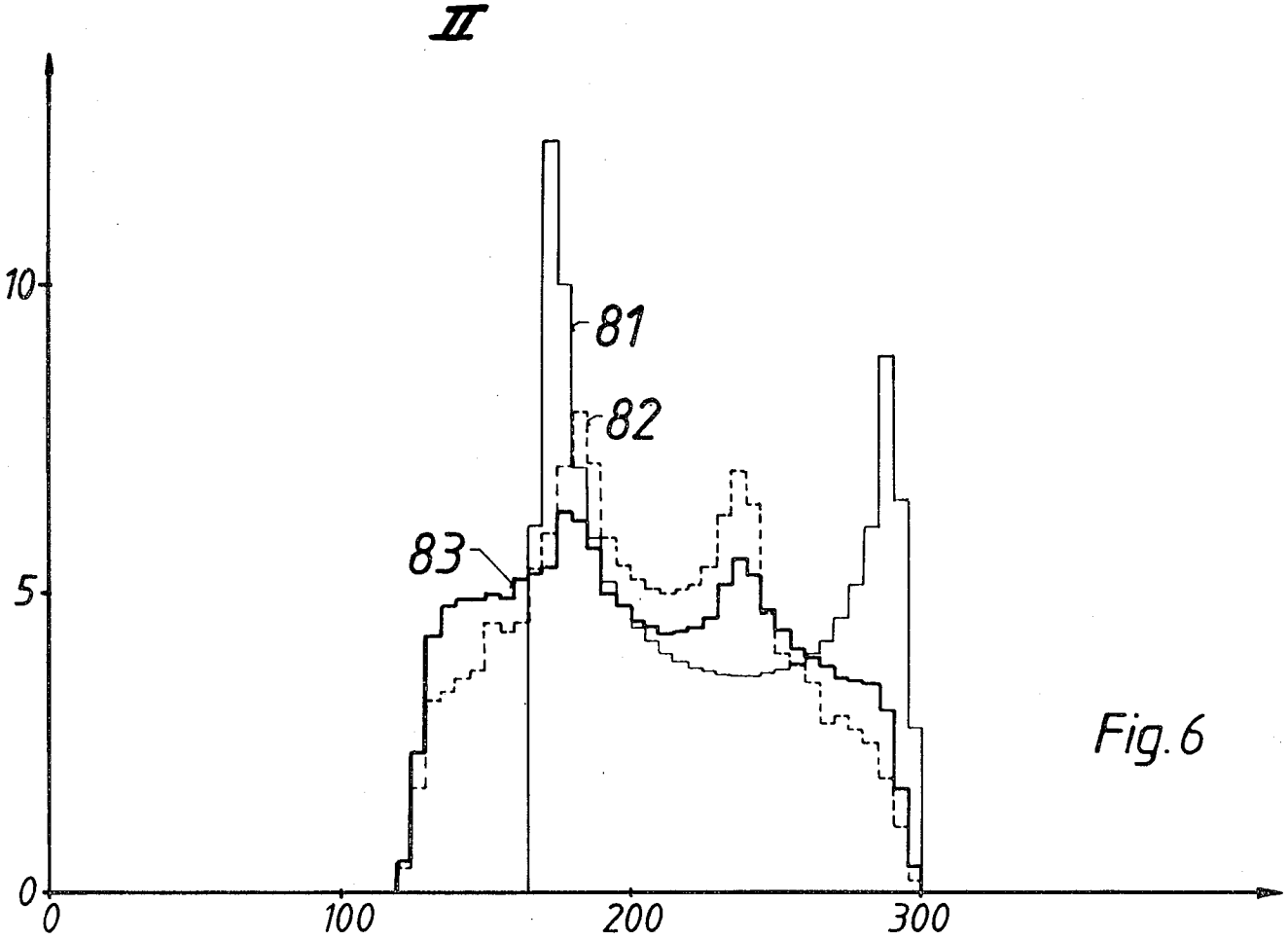
FIG. 6 graphically illustrates different states of filling of a can in accordance with the prior art and the invention.

Referring to FIG. 6, a compariosn of the material distribution of a fiber sliver in a can, for example of a diameter of 600 mm is shown. As indicated, the can filling quantity of fiber material is plotted against the can radius. The thin solid line 81 indicates the sliver deposition distribution in the case of a rotating funnel gear wheel 31 with a rotating can 11 which is not subjected to a lateral displacement. As shown, a first large material accumulation occurs in the radius of the zone ranging approximtaely from 170 to 180 mm while a second large material accumulation occurs in the radius zone ranging from approximtaely 280 to 290 mm.

The dashed line 82 illustrates the situation in a case where the can 11 is additionally effected with a lateral displacement. In this case, the fiber sliver distribution is much improved and the extreme peaks are eliminated.

The thick solid line 83 illustrates the situation if deposition of the fiber sliver is effected in accordance with the invention, e.g., rotating the cans, translating the cans and varying the speed of the cans. As indicated, the distribution i improved due to the formation of cycloid-type loops with exactly predetermined lateral distances. In addition to a further reduction of the peaks, a substantial improvement of the degree of can filling is achieved in an inner radius zone ranging from approximately 130 mm to 170 mm and in an outer radius zone ranging from approximtaely 250 mm to 290 mm. The distribution according to the thick solid line 83 particularly refers to a deposition 37 about the hole". In a position mode "up to the hole", the distribution characteristic is less marked.

The illustrated apparatus provides the advantage that such requires little space in the height dimension. Thus, accessibility is much improved. This is of particular importance with respect to a can exchange process. However, other types of structure may be used to vary the speed of the turntables and cans.

It is to be noted that with increasing magnitude of the lateral displacement of the cans, the material accumulation is better distributed. This results in a better degree of can filling. However, in this arrangement, the zone of maximum diameter receives less mateial. This is undesirable. Consequently, an optimum value has been found using a lateral displacement which extends over a distance corresponding to 5 percent to 10 percent of the can diameter. Further, an optimum degree of can filling and quantity can be achieved if the ratio of the average distance between the two axes of rotation 13, 32 to the deposition radius of the funnel gear wheel 31 is chosen in the range of from about 0.2 to 0.4 in the case of deposition "about the hole" and in the range of from 2 to 4.5 in the case of "up to the hole" deposition.

What is claimed is:

1. An apparatus for depositing a textile fiber sliver in a can, said apparatus comprising a rotatable turntable for supporting a can thereon to rotate about a first longitudinal axis;

a funnel gear wheel rotatably mounted above said turntable on a second longitudinal axis spaced from and parallel to said first longitudinal axis, said gear wheel having a funnel for passage of a sliver therethrough, said funnel being radially offset from said second axis;

means for moving said turntable relative to said gear wheel to vary the lateral distance between said axes; and means for varying the rotational speed of said turntable as a function of the lateral distance between said axes whereby said turntable is rotated at a maximum speed with said lateral distance being at a minimum and said turntable is rotated at a minimum speed with said lateral distance being at a maximum.

2. An apparatus as set forth in claim 1 which further comprises a drive means having a constant rotational speed connected to said turntable.

3. An apparatus as set forth in claim 1 which further comprises a drive shaft rotatable at a constant speed and connected with said means for varying the rotational speed of said turntable, and a rotation-imparting element connected to and between said latter means and said turntable.

4. An apparatus as set forth in claim 3 wherein said means for moving said turntable laterally includes a plate supporting said turntable thereon, a disc rotatably mounted on said plate and a crank rod fixedly mounted on one end and connected eccentrically to said disc at an opposite end.

5. An apparatus as set forth in claim 4 wherein said disc is coupled with said rotation-imparting element for rotation thereby.

6. An apparatus as set forth in claim 5 which further comprises rails for guiding said plate in a rectilinear path whereby upon rotation of said disc, said crankshaft causes said platform to reciprocate along said rails.

7. An apparatus as set forth in claim 4 wherein said rotation imparting element is a V-belt pulley mounted on said plate and said means for varying the rotational speed of said turntable includes a V-belt pulley coupled to said drive shaft and a V-belt connected between said pulley and said rotation-imparting element, and wherein one of said pulleys includes a pair of adjustably mounted pulley halves biased towards each other to maintain tension in said belt during movement of said plate while varying the speed of rotation of said turntable.

8. An apparatus as set forth in claim 7 wherein each of said pulley halves has a conical surface engaging said belt and facing the other pulley half.

9. An apparatus as set forth in claim 7 wherein each of said pulley halves has a curved surface engaging said belt and facing the other pulley half.

10. A method for depositing a textile fiber sliver in a can, in cycloid loops, said method comprising the steps of rotating a can about a first longitudinal axis;

rotating a funnel gear wheel above the can on a second longitudinal axis parallel to and spaced from the first longitudinal axis;

guiding a sliver through a funnel of the gear wheel radially offset from said second axis into the can;

moving the turntable relative to the gear wheel to vary the lateral distance between said axes; and varying the rotational speed of the turntable as a function of the lateral distance between said axes whereby the turntable is rotated at a maximum speed with said lateral distance being at a minimum and the turntable is rotated at a minimum speed with said lateral distance being at a maximum.

11. A method as set forth in claim 10 wherein said maximum speed of the turntable is 50% above the average speed of the turntable and said minimum speed is 50% below said average speed.

12. A method as set forth in claim 10 which further comprises the step of moving the turntable more rapidly in the zone of minimum distance between said axes than in the zone of maximum distance between said axes when the sliver is deposited about the hole formed by the deposited sliver in the can.

13. A method as set forth in claim 10 wherein the turntable is moved over a distance equal to between 5% and 10% of the diameter of the can.

14. A method as set forth in claim 10 wherein the ratio of the average distance between said axes relative to the radius of the funnel gear wheel is approximately 0.2 to 0.4.

15. A method as set forth in claim 10 wherein the ratio of the average distancce between said axes relative to the radius or the funnel gear wheel is approximately 2 to 4.5.

* * * * *

UNITED STATES PATENT AND TRADEMARK OFFICE

CERTIFICATE OF CORRECTION

PATENT NO. : 4,434,532

DATED : March 6, 1984

INVENTOR(S) : Peter Oehy

It is certified that error appears in the above—identified patent and that said Letters Patent is hereby corrected as shown below:

Column 3, line 22, change "Refferring" to --Referring--.

Column 3, line 57, change "3" to --13--.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*